US008646190B2

(12) United States Patent
Sartor

(10) Patent No.: US 8,646,190 B2
(45) Date of Patent: Feb. 11, 2014

(54) LAUNDRY DRYER

(75) Inventor: Luciano Sartor, Treviso (IT)

(73) Assignee: Electrolux Home Products Corporation, Zaventem (BE)

( * ) Notice: Subject to any disclaimer, the term of this patent is extended or adjusted under 35 U.S.C. 154(b) by 1963 days.

(21) Appl. No.: 11/554,609

(22) Filed: Oct. 31, 2006

(65) Prior Publication Data

US 2007/0094889 A1 May 3, 2007

(30) Foreign Application Priority Data

Nov. 3, 2005 (EP) ..... 05110287

(51) Int. Cl.
*F26B 11/02* (2006.01)

(52) U.S. Cl.
USPC ..... 34/603

(58) Field of Classification Search
USPC ..... 34/603
See application file for complete search history.

(56) References Cited

U.S. PATENT DOCUMENTS

| | | | | | |
|---|---|---|---|---|---|
| 2,752,694 | A * | 7/1956 | McCormick | 34/60 |
| 2,875,996 | A * | 3/1959 | Hullar | 432/67 |
| 4,360,977 | A * | 11/1982 | Frohbieter | 34/86 |
| 4,488,364 | A * | 12/1984 | Herschel | 34/86 |
| 4,702,018 | A * | 10/1987 | Hastings | 34/130 |
| 4,972,605 | A * | 11/1990 | Montalvo | 34/513 |
| 5,363,569 | A * | 11/1994 | Kadakia | 34/601 |
| 5,881,576 | A * | 3/1999 | Davies, Jr. | 68/3 R |
| 6,874,248 | B2 * | 4/2005 | Hong et al. | 34/239 |
| 6,941,679 | B1 * | 9/2005 | Harris et al. | 34/596 |
| 2004/0010936 | A1 * | 1/2004 | Han | 34/595 |
| 2004/0103556 | A1 * | 6/2004 | Bang | 34/595 |
| 2004/0134093 | A1 * | 7/2004 | Han | 34/595 |
| 2004/0159010 | A1 * | 8/2004 | Hwang | 34/601 |
| 2004/0163275 | A1 | 8/2004 | Hwang | |
| 2005/0268483 | A1 * | 12/2005 | Park et al. | 34/603 |
| 2006/0218817 | A1 * | 10/2006 | Lee | 34/604 |
| 2006/0265899 | A1 * | 11/2006 | Renzo | 34/603 |
| 2007/0006485 | A1 * | 1/2007 | Kim | 34/603 |
| 2007/0094889 | A1 * | 5/2007 | Sartor | 34/601 |
| 2008/0141558 | A1 * | 6/2008 | Bae et al. | 34/595 |

FOREIGN PATENT DOCUMENTS

| | | | |
|---|---|---|---|
| DE | 19811968 | A1 | 9/1999 |
| EP | 0 588 100 | A1 | 3/1994 |
| EP | 0588100 | A | 3/1994 |

OTHER PUBLICATIONS

European Search Report for EP 05110287, dated Apr. 21, 2006, 2 pages.

* cited by examiner

*Primary Examiner* — Steve M Gravini
(74) *Attorney, Agent, or Firm* — Pearne & Gordon LLP

(57) ABSTRACT

The present invention refers to a laundry dryer having a removable front casing panel (1).

A laundry dryer according to the invention comprises a front casing panel (1) and a frame structure (4) for accommodating a tub (5) and operational component parts (6) which are required for drying laundry, said frame structure (4) comprises a front supporting member (12) having means (21) for removably mounting said front casing panel (1). The laundry dryer is characterized in that said front supporting member (12) comprises a portion (13) that forms a component part of said tub (5).

8 Claims, 2 Drawing Sheets

LAUNDRY DRYER

The present invention refers to a laundry dryer having a removable front casing panel.

Laundry treating machines of known type generally comprises a cabinet assembly having a base portion, a rear wall, a front wall and a pair of bars extending parallel to the base at the top of the machine between the rear and the front wall. Two lateral panels and a top cover are provided for closing the cabinet. The front wall has not only decorative functions but principally it serves for supporting operational component parts of the machine, such as a laundry treating tub, a control unit and so on.

A drawback of this kind of machines consists in that disassembling the front wall all the operational component parts lose their support and fall down causing cabinet damages. This condition is particularly undesired when a maintenance intervention is needed because the disassembling operations are disadvantageously complicated, especially if the intervention must be performed at home of the user.

From the European Patent No. EP 0 588 100 it is known a laundry treating machine having a frame structure for accommodating operational component parts which are required for the treatment of laundry so as to form a workable and operable basic appliance on which housing panels such as lateral walls, front wall and a top wall can be attached. If the housing panels are removed, such a laundry treating machine can continue working. According to the cited patent a laundry treating machine embodied in a washing machine has a front panel that is practically formed by a decorative cover mounted on a stabilising plate having supporting functions for operational component parts. Even if this solution offers the possibility to select different covers for changing the outside design of the machine, it cannot offers the option to use the same stabilising plate for machines having operational components parts disposed in a different manner. This forces the manufacturer to provide a specific plate for each washing machine model, which is a solution that complicates a lot the manufacturing and assembling processes other than being extremely expensive.

EP 0 588 100 also discloses a laundry dryer wherein the cabinet comprises a frame having a base portion, a rear wall, two front bars, a front reinforcing bar which connects the front bars in the upper region, and lateral reinforcing bars disposed on the left and right in the upper lateral region. In this case the frame has no front stabilising plate but only two front bars and therefore the whole frame can result to be structurally too weak for support efficiently the vibrations and forces produced when the dryer works.

The aim of the present invention is therefore to solve the noted problems, eliminating the drawbacks of the cited known art and thus providing a laundry dryer having a portion of an operational component part that is also part of the machine supporting frame.

Another purpose of the present invention is to provide a laundry dryer in which the front panel can be easily changed with another one of different design.

Still another purpose of the invention is to provide a laundry dryer having a supporting frame of improved stiffness and having a reduced number of components. The same frame being lighter than the supporting frame of known type.

A further purpose of the present invention is to provide a laundry dryer that simplifies the manufacturing and assembling processes.

Advantages, objects, and features of the invention will be set forth in part in the description which follows and in part will become apparent to those having ordinary skill in the art upon examination of the following or may be learned from practice of the invention. The objects and advantages of the invention may be realised and attained as particularly pointed out in the appended claims.

The accompanying drawings, which are included to provide a further understanding of the invention and are incorporated in and constitute a part of this specification, illustrate a possible embodiment of the invention and together with the description serve to explain the principles of the invention.

Figure 1:
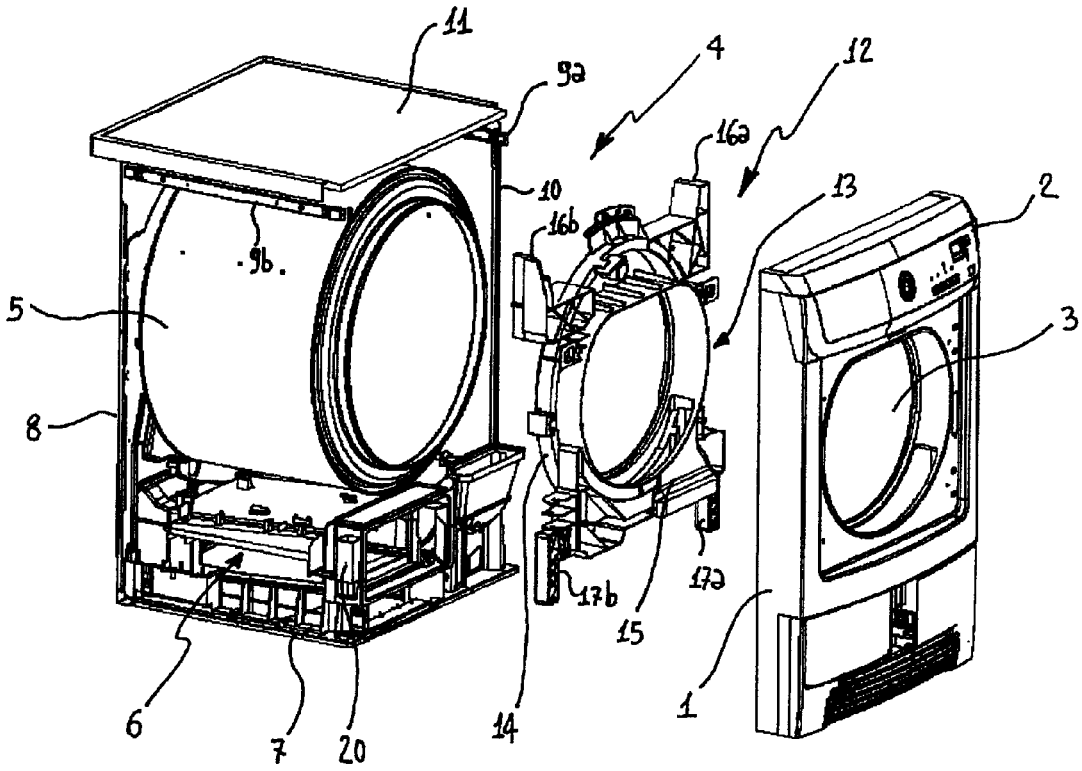
FIG. 1 shows a perspective view of a partly disassembled laundry dryer according to the present invention.

Referring to FIG. 1 the laundry dryer according to the invention comprises a front casing panel 1 on which it is provided a control unit 2 allowing the user to operate the dryer. An opening 3 is provided on the panel 1 for introducing laundry to be dried in the dryer. A frame structure 4 is provided for accommodating a tub 5, containing a drum rotating about a horizontal axis, and operational component parts 6 which are required for drying laundry such as air circulating means, heating means, filtering means, motor means, air conduits, liquid draining means and so on.

The frame structure 4 preferably comprises a base portion 7 and a rear wall 8 associated to the base 7 so as to form an L-shaped assembly. The frame 4 further comprises a pair of lateral bars 9*a*, 9*b* disposed on a upper region of the rear wall 8 and extending substantially parallel to the base 7. The frame structure 4 is provided with means of known type suitable for removably securing casing panels 10, 11 on it so as to form the outer casing of the dryer. Said means can be, for example, snap connectors or through-joints. A pair of opposite lateral casing panels 10 (in FIG. 1 only one of these panels is shown) is mounted so as to join a lateral bar 9*a*, 9*b*, the rear wall 8, and the base 7 thereby forming two lateral sides of a dryer casing. A cover top 11 is removably mounted on the two bars 9*a*, 9*b*.

According to the invention, the frame structure 4 comprises a front supporting member 12 having a portion 13 that acts not only as supporting structure for the tub 5 and for the other operational components parts 6 of the dryer like air conduits, but it forms also an operative part of the tub 5 itself. In particular, said portion 13 comprises an annular element 14 adapted to be attached to the tub 5 so as to form a mouthpiece through which laundry to be dried can be introduced within the tub. The annular portion 14 is further provided with air conveying means 15 for guiding air from or to the tub 5 according to the direction of the air flow imposed by the air circulating means.

Figure 2:
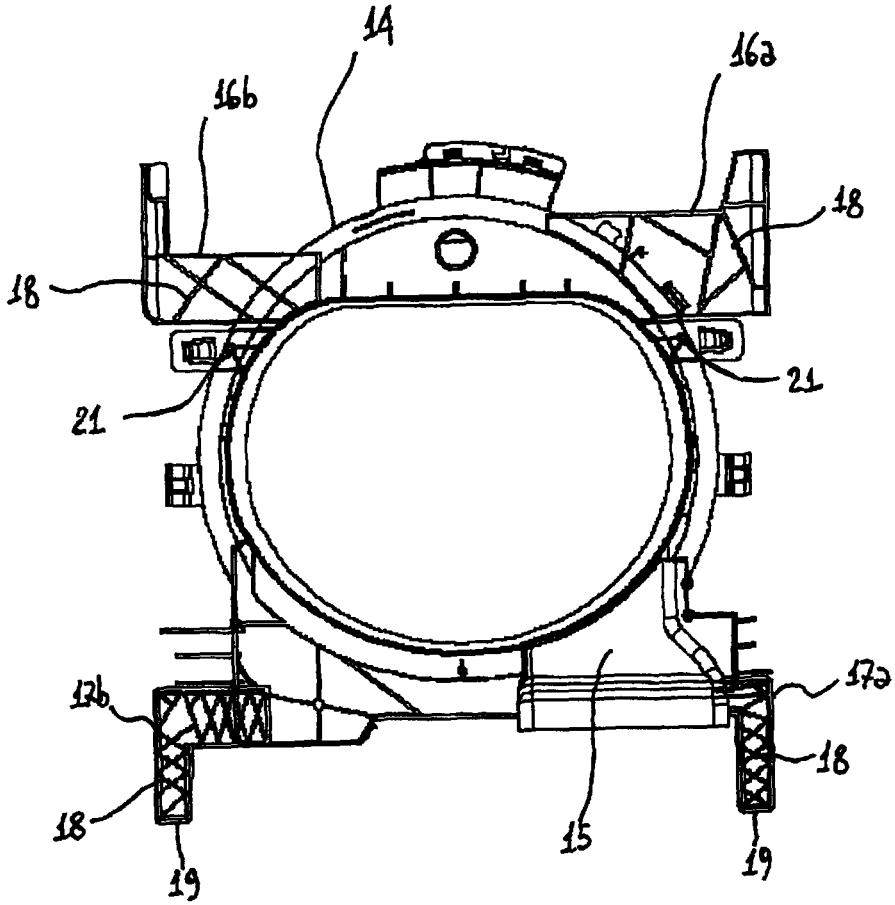
FIG. 2 shows a front view of the front supporting member comprising a component part of the dryer tub.

The annular element 14 is associated to the lateral bars 9*a* and 9*b* and to the base portion 7, i.e. to the other components of the frame structure 4, by means of connecting members 16*a*, 16*b*, 17*a* and 17*b*. With reference to FIG. 2, these members are in the form of four L-shaped connectors having stiffening walls 18. The lower members 17*a* and 17*b*, have a male portion 19 that is received in a corresponding seat 20 formed on the base 7. The upper members 16*a*, 16*b* can be connected to the bars 9*a*, 9*b* by means of screws of other fastening means of known type.

Connecting members 16*a*, 16*b*, 17*a*, 17*b* can be made in a single piece with the annular element 14 in order to reduce the overall number of pieces needed to form the front supporting member 12. Another possible arrangement of the members 16*a*, 16*b*, 17*a*, 17*b* consists in grouping the upper members 16*a*, 16*b* in a first item and the lower members 17*a*, 17*b* in a second item. These items or the single connecting member

16*a*, 16*b*, 17*a*, 17*b* can be joined to the annular element 14 by means of any known kind of fastening means such as screws or through-joints.

The front supporting member 12 has means 21 for removably receiving the front casing panel 1 such that the same member 12 can be used in combination with different types of panels 1 thereby giving the possibility to the dryer manufacturer to change the machine design in a simplified and economic way. In FIG. 2 said means 21 are in the form of cavities in which a screw or a pin member can be removably received; however other known means can be used for connecting the front support member 12 to the front casing panel 1. When the front panel 1 is mounted on the front supporting member 12 the aperture 3 couples with the annular element 14. A door (not shown in FIG. 1) for closing the aperture 3 can be pivotally attached to the panel 1. The control unit 2 carrying input means for operating the dryer can be made as a separate piece to be mounted on the panel 1 or, as an alternative, it can also be made in a single piece with the panel 1 itself. In the latter case component assembling errors and difficulties in connecting the panel 1 with the control unit 2 during the assembling operations will be advantageously avoided.

Advantageously, in order to simplifying the laundry dryer manufacturing process and the weight of the appliance, the front supporting member 12 can be made, at least partly, of plastic material.

Conclusively it can be stated that the laundry dryer according to the present invention allows the integration of an operative component part of a tub with a structural and supporting portion of the appliance cabinet. The same laundry dyer is highly versatile because allows the sharing of components among different models of drying machines.

The invention claimed is:

1. A laundry dryer comprising:

a frame structure (4) for accommodating a tub (5) and operational component parts (6) which are required for drying laundry, said frame structure (4) comprising a base portion (7), a ceiling portion extending substantially parallel to said base portion (7), and a rear wall (8) connecting said base and ceiling portions;

a first front casing panel (1) removably associated to a front supporting member (12) which comprises a portion (13) that forms a component part of said tub (5), wherein said front supporting member (12) comprises connecting members (16*a*, 16*b*, 17*a*, 17*b*) for removably attaching said front supporting member (12) to the ceiling portion and to the base portion (7) thereby forming a structural part of said frame structure (4) that connects the base portion (7) with the ceiling portion.

2. A laundry dryer according to claim 1 wherein said portion (13) comprises an annular element (14) adapted to be connected to the tub (5) for forming a mouthpiece through which laundry to be dried can be introduced, said annular element (14) being provided with air conveying means (15) for guiding air from or to said tub (5).

3. A laundry dryer according to claim 1 wherein said ceiling portion comprises lateral bars (9*a*, 9*b*) disposed on a upper region of said rear wall (8).

4. A laundry dryer according to claim 2 wherein the annular element (14) and the connecting members (16*a*, 16*b*, 17*a*, 17*b*) are made in a single piece.

5. A laundry dryer according to claim 1 wherein said front casing panel (1) comprises a control unit (2) for operating the dryer and an opening (3) for accessing said tub (5) when the front casing panel (1) is mounted on said front supporting member (12).

6. A laundry dryer according to claim 5 wherein said control unit (2) and said front casing panel (1) are made in a single piece.

7. A laundry dryer according to claim 1 wherein said front supporting member (12) is made, at least partly, of plastic material.

8. A laundry dryer according to claim 1 wherein second casing panels (10, 11) are associated to the frame structure (4) so as to be removable therefrom independently on said front supporting member (12).

* * * * *